United States Patent [19]

Momoi

[11] 4,305,188

[45] Dec. 15, 1981

[54] METHOD OF MANUFACTURING CATHODE ASSEMBLY

[75] Inventor: Kouichi Momoi, Zama, Japan

[73] Assignee: Sony Corporation, Tokyo, Japan

[21] Appl. No.: 99,586

[22] Filed: Dec. 3, 1979

Related U.S. Application Data

[63] Continuation of Ser. No. 929,343, Jul. 31, 1978, abandoned.

[30] Foreign Application Priority Data

Aug. 11, 1977 [JP] Japan ..... 52-96479

[51] Int. Cl.[3] ..... H01J 9/02

[52] U.S. Cl. ..... 29/25.17

[58] Field of Search ..... 29/25.17; 75/170

[56] References Cited

U.S. PATENT DOCUMENTS

| | | | |
|---|---|---|---|
| 2,720,458 | 10/1955 | Kates | 75/170 |
| 2,945,295 | 7/1960 | Feaster | 228/220 |
| 3,823,453 | 7/1974 | Van Stratum et al. | 29/25.14 |
| 3,919,751 | 11/1975 | Buescher et al. | 313/337 |
| 4,079,164 | 3/1978 | Misumi | 75/170 |
| 4,114,243 | 9/1978 | Soend et al. | 228/179 |

*Primary Examiner*—John McQuade

*Attorney, Agent, or Firm*—Hill, Van Santen, Steadman, Chiara & Simpson

[57] ABSTRACT

A method of manufacturing a cathode assembly for use with an electron tube in which the cathode assembly is comprised of a metal cap composed principally of nickel Ni and welded to a cathode sleeve composed principally of nickel Ni, an electron emissive coating layer formed on a surface of the base metal, and a supporting member welded to the cathode sleeve. The method comprises the step of treating or conducting at least the metal cap under a solution heat treatment.

12 Claims, 5 Drawing Figures

METHOD OF MANUFACTURING CATHODE ASSEMBLY

This is a continuation of application Ser. No. 929,343, filed July 31, 1978, now abandoned.

BACKGROUND OF THE INVENTION

1. Field of the Invention

The present invention relates generally to a method of manufacturing a cathode assembly for use with an electron tube and is directed more particularly to a method of manufacturing a cathode assembly for use with an electron tube such as a cathode ray tube which has a long life span of thermionic electron emission.

2. Description of the Prior Art

In a prior art cathode ray tube such as a television receiver tube, the thermionic electron emission characteristics and life span of the cathode assembly of the electron gun thereof are the main factors which will determine the characteristics and life span of the cathode ray tube.

The cathode assembly used in the electron gun of a cathode ray tube such as an ordinary television receiver tube uses an indirect heater cathode type that consists of a cathode sleeve 1 and a heater coil 2 disposed therein. A cap 4, which is made of metal and will serves as a base metal for the cathode assembly, is attached to the cathode sleeve 1 at its one end, and a thermionic electron emissive oxide material 3 is coated on a bottom plate 4*a* of the cap 4 to form a thermionic electron emission surface or layer. The cap 4 is attached to the cathode sleeve 1 by spot-welding its cylindrical wall portion 4*b* along an annular groove P to the cathode sleeve 1. The cap 4 i.e. base metal of the cathode assembly is of such a composition which contains nickel Ni as its main substance, and 0.04–0.5 weight percent of magnesium Mg and 0.0–25 weight % of tungsten W added to the former as reducing agent or activator. The cathode sleeve 1 having the cap 4 attached thereto at one end thereof is electrically and mechanically connected to terminal pins 6 which are carried by a supporting base 5 made of ceramic or the like. The coupling of the cathode sleeve 1 to the pins 6 is carried out in such a manner that V-shaped tabs i.e. supporting members 7 are welded to the cathode sleeve 1 and each of the tabs 7 is welded to each of the pins 6, respectively.

Recently, in such a type of a cathode assembly or structure, in order to obtain the start of thermionic electron emission as quickly as possible from the switching-on of power supply or to thermal-balance the cathode structure at a desired temperature and maintain stable operation, the cathode sleeve 1 is made of Ni-Cr alloy, and then is subjected to a heating treatment in hydrogen gas $H_2$ atmosphere containing water at a temperature range from 700° C. to 900° C. for about 30 minutes to oxidize and hence darken chromium Cr on the surface of the cathode sleeve 1 or that the surface of the base metal, on which the cathode material is coated, is subjected to a cleaning treatment. However, if the above thermal or heating treatment is carried out for the cathode sleeve 1, the thermionic electron emissive characteristics thereof become unstable and hence the life span of the cathode structure or assembly can not be made long enough.

The inventor of the present invention finds out that the above defects are caused by the grain boundary which is formed in Ni contained in the base metal. That is, it is required so as to make the thermionic electron emission from the cathode stable and prolong the life span thereof that the diffusion of the reducing agent or activator in the base metal such as magnesium Mg into the cathode material be maintained for a long time period. However, the cooling or quenching after the heating during the above thermal treatment is generally carried out by a so-called natural cooling which is rather slow, so that grains of nickel Ni which are relatively large in size are produced in the base metal during the slow or gradual cooling. Through the grain boundary the magnesium Mg serving as reducing agent or activator is apt to be diffused into the cathode material abnormally quickly, so that the supply amount of reducing agent or activator from the base metal becomes increased and the consumption amount of the reducing agent increases substantially as compared with the anticipated amount. As a result, it may be considered that when the above thermal treatment has taken place, the thermionic electron emissive characteristics become unstable and the life span of the cathode assembly is shortened.

Especially, the above heating treatment, for example, for the darkening treatment is carried out under such a state that the cathode sleeve 1 is attached to the ceramic base 5, so that the thermal capacity of the whole cathode structure becomes relatively large. Further, the ceramic base 5 is apt to be cracked due to the thermal stress, so that the thermal treatment must be carried out carefully. Accordingly, when the heating treatment for the darkening treatment is achieved under the above state and then cooled naturally, this cooling takes a rather gradual cooling pattern as shown in the graph of FIG. 2 in which the ordinate represents temperature in 0°C. and the abscissa represents time in minutes, and hence the above-mentioned defect is caused significantly.

OBJECTS AND SUMMARY OF THE INVENTION

Accordingly, an object of the present invention is to provide a novel method of manufacturing a cathode assembly free from the drawbacks inherent in the prior art.

A further object of the present invention is to provide a method of manufacturing a cathode assembly for use with an electron tube which can avoid any formation of a grain boundary in a nickel Ni base metal.

A still further object of the invention is to provide a method for heating a base metal of a cathode assembly by which the cathode assembly can be made long in its life span and stabilized in thermionic electron emissive characteristics.

According to an aspect of the present invention there is proposed a method of manufacturing a cathode assembly for use with an electron tube in which the cathode assembly is comprised of a metal cap composed principally of nickel Ni and welded to a cathode sleeve composed principally of nickel Ni, an electron emissive coating layer formed on the surface of the base metal and a supporting member welded to the cathode sleeve, the method comprising the step of treating or conducting at least the metal cap under a solution heat treatment.

The other objects, features and advantages of the present invention will become apparent from the following description taken in conjunction with the accompanying drawings.

DESCRIPTION OF THE PREFERRED EMBODIMENT

An example of the method of manufacturing a cathode assembly for use with an electron tube such as a cathode ray tube according to the invention will be hereinbelow described with reference to FIGS. 1, 3 and 4.

Figure 1:
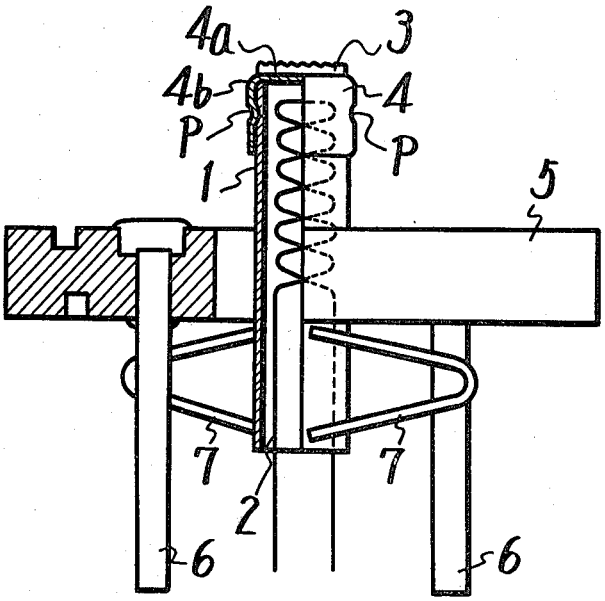
FIG. 1 (PRIOR ART)
FIG. 1 is a side view, partially in cross-section of a cathode assembly used for explaining the present invention.
Figure 2:
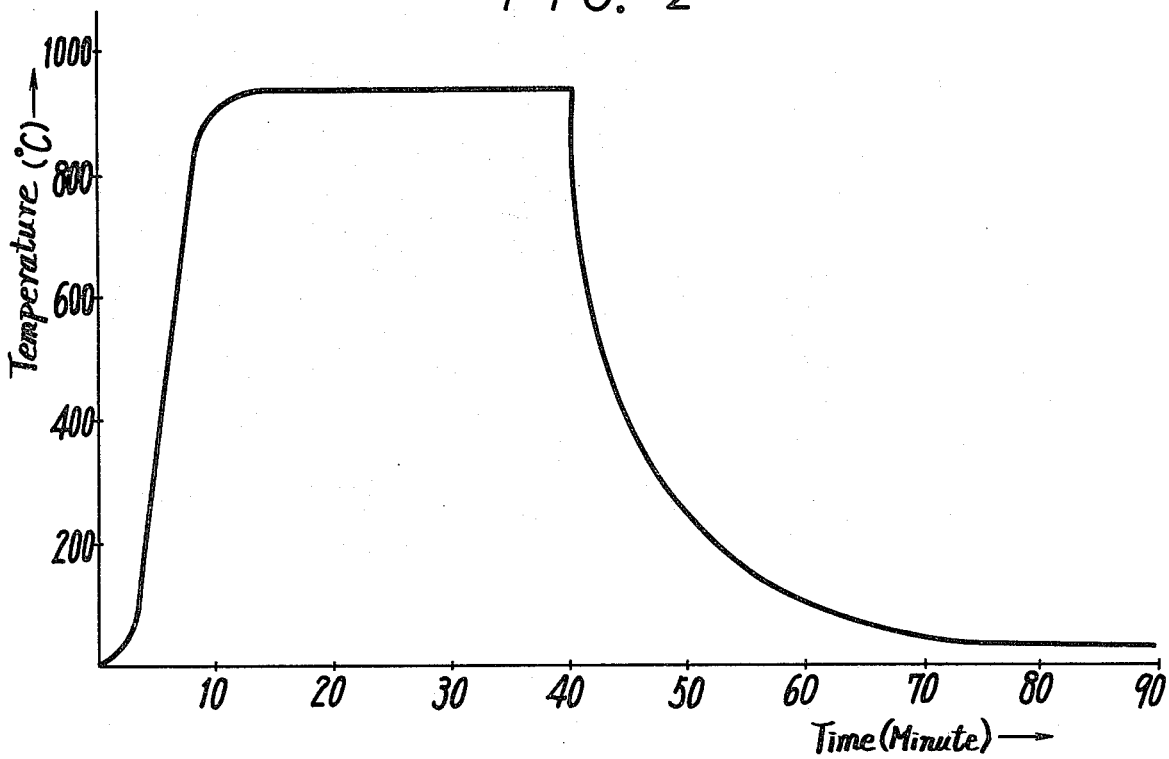
FIG. 2 is a graph showing a heat pattern of a darkening treatment.

With the present invention, during the process of manufacturing a cathode ray tube, at least the base metal of a cathode assembly or structure or the cap 4 in the indirect heating type cathode shown in FIG. 1 is subjected to a solution treatment. This solution treatment is carried out in such a manner that the base metal i.e. cap 4, which is composed of the alloy of nickel Ni, tungsten W and magnesium Mg, is heated up to a temperature higher than the solidus of the above Ni-W-Mg alloy but lower the liquidus thereof and then quenched rapidly. This heating temperature is desirably between 1000° C. and 1400° C. and more preferably 1080° C. and 1250° C. In this case, the rate of temperature increase is relatively high, for example, at such a velocity that the cap 4 arrives at the above mentioned temperature within 10 minutes and then is kept for a time period more than 1 minute, for example, 1 to 10 minutes, preferably 3 to 5 minutes. Thereafter, the cap 4 is quenched to a temperature lower than 100° C., for example, room temperature within 5 minutes, preferably 1minute. The time period required for quenching the cap 4 is preferred to be as short as possible.

Figure 3:
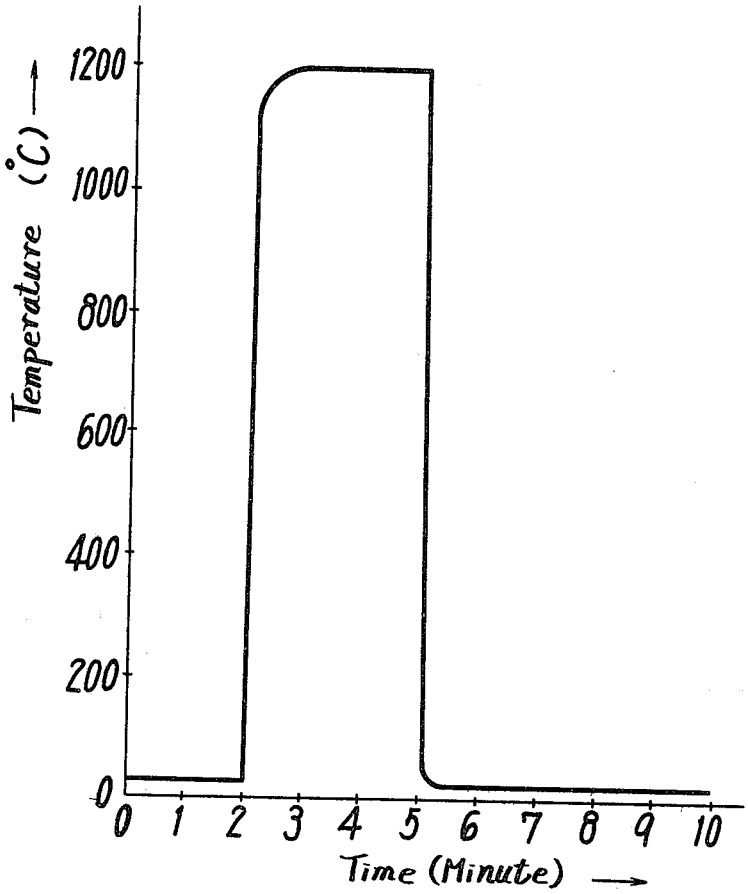
FIG. 3 is a graph showing a heat pattern of a solution treatment of the method according to the present invention.
Figure 4:
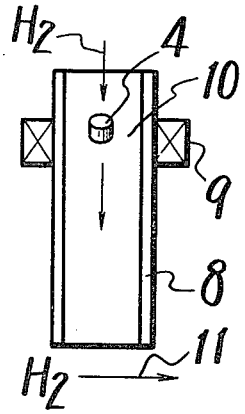
FIG. 4 is a schematic diagram showing an example of a solution treatment apparatus for a base metal.
Figure 5:
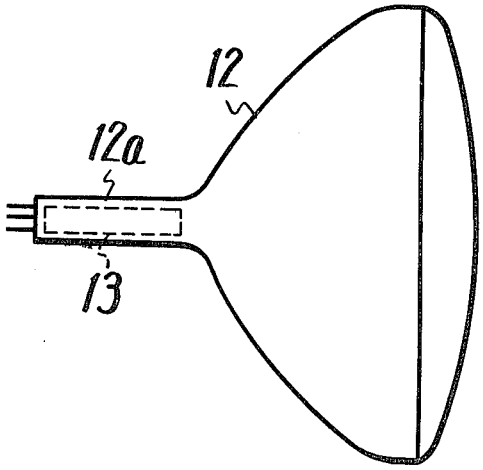
FIG. 5 is a side view showing a cathode ray tube with a cathode assembly according to the invention.

FIG. 3 is a graph showing an example of the heat pattern of the solution treatment in which the ordinate represents the temperature in °C. and the abscissa represents the time in minutes, respectively.

This solution treatment is applied to, for example, the base metal only i.e. the cap 4 before being attached to the cathode sleeve 1. An example of the apparatus which carries out the above solution treatment is shown in FIG. 4. This apparatus includes a vertical heating furnace 8 which contains therein a nonoxidizing gas atmosphere such as nitrogen gas $N_2$ rare gas or hydrogen gas $H_2$. In the upper portion of the heating furnace 8 there is provided by a heating device 9 a heating zone 10 which is maintained at the heating temperature required for the solution treatment. In the lower portion of the heating furnace 8 there is a zone 11 which serves to flow therethrough the quenching nonoxidizing gas such as $N_2$, rare gas or $H_2$. The base metal or cap 4 of the cathode assembly is located in the heating zone 10 and then subjected to the above heating treatment. Thereafter, the cap 4 is dropped into the lower zone 11 to be quenched quickly.

The cap 4, which is already solution-treated as set forth above, is then attached to the cathode sleeve 1 at its upper end portion as described in connection with FIG. 1, then the sleeve 1 is fixed to the support base 5, and thereafter they are subjected to the darkening treatment.

After the darkening treatment for the cathode sleeve 1 has been finished, the electron emissive oxide material is coated or sprayed on the bottom surface 4*a* of the cap 4 to form the thermionic electron emissive oxide material layer 3.

The cathode assembly of the present invention constructed as above is mechanically coupled to the other electrodes such as first to fifth grid electrodes with a predetermined relation to be an electron gun. The electron gun thus formed is sealed up in a neck portion 12*a* of an envelope of a cathode ray tube 12 as indicated at 13 as shown in FIG. 9 and then gas in the envelope is evacuated to form a desired cathode ray tube.

The cathode ray tube thus formed is stable in its thermionic electron emissive characteristics and its life span is longer than that of the prior art whose cathode assembly is made by employing the darkening treatment without the solution treatment by one-half times. This may be caused by the fact that any grain is hard to be grown in the base metal which has once been subjected to the solution treatment even if it is cooled gradually after the heating treatment for the darkening treatment and so on.

The above description is given on the example of the invention in which the solution treatment is employed before the darkening treatment, but it is ascertained that the same effect can be obtained by carrying out the solution treatment after the darkening treatment.

It is also possible different from the above two examples in which the solution treatment is carried out independently from the other heating treatments that the solution treatment is achieved with the other heating treatments which can be carried out under a heating of high temperature and rapid quenching. That is, the base metal or cap 4, which is welded to the cathode sleeve 1, is partially or locally heated to achieve the solution treatment. This partial solution treatment can be carried out by, for example, the irradiation of infrared rays, laser light or induction heating.

This partial solution treatment can be further carried out by inserting a heater, which can be heated up to a temperature capable of achieving the solution treatment, into the cathode sleeve 1 and supplying, for example, a voltage higher than the operating voltage to the heater to heat the base metal at a high temperature such as 1100° C. for 1 minute and then to gradually lower the voltage applied to the heater. Then, the base metal i.e. cap 4 is quenched lower than 100° C., for example, to the room temperature within 1 minute. In this case, since the base metal is heated by the heat from the heater in a short time period and the heating time is short, even though the heat capacity of the cathode assembly is large, the heating of the base metal is finished before the whole cathode assembly is heated up. In other words, a so-called local heating is carried out, so that the cathode assembly is not heated up to very high temperatures and hence the base metal is quenched quickly by only cutting off the power supply to the heater. Thus, the solution treatment can be achieved effectively.

It will be apparent that many modifications and variations could be effected by one skilled in the art without departing from the spirit or scope of the novel concepts of the present invention, so that the spirit or scope of the invention should be determined by the appended claims.

I claim as my invention:

1. In a method of manufacturing a structure for enclosing the filament of an indirectly heated cathode assembly involving the steps of securing a nickel base alloy cap to a nickel-chromium alloy sleeve, darkening the sleeve by heating in a reducing atmosphere containing water vapor, and applying a coating of electron emissive material onto a portion of the exterior of said cap, the improvement whereby the electron emissive characteristics of the cathode assembly are improved which comprises:

solution heat treating said nickel base alloy cap in a non-oxidizing atmosphere at a temperature of from 1000° to 1400° C. to effect a solution heat treatment thereof and quenching said cap in a non-oxidizing atmosphere to a temperature below 100° C. within 5 minutes, said solution heat treating and said quenching being carried out prior to application of said electron emissive material onto said cap.

2. A method according to claim 1 in which said cap is attached to said sleeve and the combination of the two is subjected to said solution heat treating and quenching.

3. A method according to claim 1 wherein said non-oxidizing atmosphere consists essentially of hydrogen.

4. A method according to claim 1 wherein said non-oxidizing atmosphere consists essentially of nitrogen.

5. A method according to claim 1 wherein said non-oxidizing atmosphere consists essentially of inert gas.

6. A method according to claim 1 wherein said cap is solution heat treated for from 1 to 10 minutes after reaching said temperature.

7. A method according to claim 1 wherein said cap is solution heat treated for a period of from 3 to 5 minutes after reaching said temperature.

8. A method according to claim 1 wherein said cap is composed principally of nickel and contains about 0.0 to 25 weight percent tungsten and 0.04 to 0.5 weight percent magnesium.

9. A method according to claim 1 wherein the solution heat treating is carried out by application of a laser light.

10. A method according to claim 1 wherein said solution heat treating is carried out by means of a heater positioned adjacent to said cap.

11. A method according to claim 1 wherein the solution heat treating is carried out by an induction heating process.

12. A method according to claim 1 wherein said solution heat treating is carried out at a temperature in the range from 1080° C. to 1250° C.

* * * * *